United States Patent [19]

Sayler et al.

[11] Patent Number: 4,531,461

[45] Date of Patent: Jul. 30, 1985

[54] SOLID FUEL PULVERIZING AND BURNING SYSTEM AND METHOD AND PULVERIZER AND BURNER THEREFOR

[75] Inventors: William H. Sayler, Salt Lake City; Justin C. White, Magna, both of Utah

[73] Assignee: T.A.S., Inc., Magna, Utah

[21] Appl. No.: 588,900

[22] Filed: Mar. 12, 1984

Related U.S. Application Data

[63] Continuation of Ser. No. 378,347, May 14, 1982, abandoned, which is a continuation-in-part of Ser. No. 216,267, Dec. 15, 1980, abandoned.

[51] Int. Cl.[3] ..... F23D 17/00

[52] U.S. Cl. ..... 110/106; 431/183; 241/58; 241/275; 110/261; 110/264; 110/265

[58] Field of Search ..... 110/261-265, 110/347, 106 R; 241/56, 58; 431/183

[56] References Cited

U.S. PATENT DOCUMENTS

| | | | |
|---|---|---|---|
| 388,375 | 8/1888 | Ruddick . | |
| 617,522 | 1/1899 | Day . | |
| 657,579 | 9/1900 | White . | |
| 744,220 | 11/1903 | Neu . | |
| 862,720 | 8/1907 | Day . | |
| 919,327 | 4/1909 | Day . | |
| 1,048,869 | 12/1912 | Pitcairn . | |
| 1,411,846 | 4/1922 | Donaldson . | |
| 1,513,279 | 10/1924 | Sawford . | |
| 1,541,903 | 6/1925 | Crites . | |
| 1,543,997 | 6/1925 | Gidino . | |
| 1,649,147 | 11/1927 | Blyth . | |
| 1,656,907 | 1/1928 | Bansen . | |
| 1,669,239 | 5/1928 | Grindle . | |
| 1,713,297 | 5/1929 | Olston . | |
| 1,765,309 | 6/1930 | O'Neill . | |
| 1,780,220 | 11/1930 | Baumgartner . | |
| 1,801,842 | 4/1931 | Briggs . | |
| 1,921,166 | 8/1933 | Peabody . | |
| 1,957,965 | 5/1934 | Kennedy et al. . | |
| 2,087,869 | 7/1937 | Blodgett | 431/183 |
| 2,183,596 | 12/1939 | Trinks | 431/183 |
| 2,497,088 | 2/1950 | Lykken et al. . | |
| 2,561,388 | 7/1951 | Lykken et al. . | |
| 2,561,564 | 7/1951 | Crites | 241/58 |
| 2,800,093 | 7/1957 | Burg . | |
| 3,049,085 | 8/1962 | Musat et al. | 431/183 |
| 3,065,919 | 11/1962 | Burkett et al. | 241/275 |
| 3,147,795 | 9/1964 | Livingston et al. | 431/284 |
| 3,299,841 | 1/1967 | Hemker et al. . | |
| 3,589,315 | 6/1971 | Hart . | |
| 3,610,542 | 10/1971 | Yamagishi . | |
| 3,622,086 | 11/1971 | Yamagishi . | |
| 3,934,522 | 1/1976 | Booker . | |
| 3,987,970 | 10/1976 | Burkett . | |
| 4,057,021 | 11/1977 | Schoppe | 110/264 |
| 4,089,628 | 5/1978 | Blackburn | 110/347 |
| 4,130,389 | 12/1978 | Kaburagi et al. | 431/183 |
| 4,147,116 | 4/1979 | Graybill . | |
| 4,150,631 | 4/1979 | Frey et al. . | |
| 4,157,889 | 6/1979 | Bonnel . | |
| 4,173,189 | 11/1979 | Cooper . | |
| 4,184,640 | 1/1980 | Williams . | |
| 4,206,712 | 6/1980 | Vatsly . | |
| 4,221,174 | 9/1980 | Smith et al. . | |
| 4,241,673 | 12/1980 | Smith et al. . | |
| 4,249,871 | 2/1981 | Gunnerman . | |
| 4,263,856 | 4/1981 | Rickard . | |
| 4,321,034 | 3/1982 | Taccone | 110/264 |

FOREIGN PATENT DOCUMENTS

| | | |
|---|---|---|
| 77990 | 4/1962 | France . |
| 1326557 | 4/1963 | France . |

OTHER PUBLICATIONS

Raymond Vertical Mill, pp. 8-38, 8-43, 8-44 from Perry's "Chemical Engineer's Handbook", Bulletin No, 118, Combustion Engineering, Inc.

*Primary Examiner*—Henry C. Yuen

*Attorney, Agent, or Firm*—Mallinckrodt, Mallinckrodt, Russell & Osburn

[57] ABSTRACT

A system for pulverizing and burning solid fuel, such as coal or other fossil fuel, characterized by a possible turndown ratio of up to at least fifteen to one, includes a unique pulverizer capable of both impact and autogenous pulverizing of the fuel so that about 80% will be no more than 40 microns in size, and a unique burner which includes a valved firing nozzle having a firing conduit with firing orifice and internal turbulating means for a mixture of primary air and pulverized solid fuel, and a controlled secondary air supply. A movable valve element, preferably in the form of a double-tapered diffuser positioned downstream from the firing orifice, controls outflow of a turbulent stream of the mixed primary air and fuel from the firing orifice into an ignition chamber and controls flame shape.

17 Claims, 12 Drawing Figures

SOLID FUEL PULVERIZING AND BURNING SYSTEM AND METHOD AND PULVERIZER AND BURNER THEREFOR

RELATED APPLICATIONS

The present application is a continuation of our similarly entitled copending application Ser. No. 06/378,347, filed May 14, 1982, now abandoned, which itself is a continuation-in-part of our copending application Ser. No. 06/216,267, filed Dec. 15, 1980, now abandoned, entitled "Pulverized Solid Fuel Burning Apparatus".

Note is also made of copending applications Ser. No. 304,860, filed Sept. 23, 1981, entitled "Apparatus and Method for the Pulverization and Burning of Solid Fuels", and Ser. No. 482,503 filed Apr. 6, 1983, similarly entitled.

BACKGROUND OF THE INVENTION

1. Field

The invention is concerned with systems and methods for pulverizing solid fuels, such as coal or other fossil fuels, and for burning such pulverized fuels suspended in a stream of air.

2. State of the Art

The combustion of solid fuels in pulverized form in furnaces has been practiced for many decades, probably beginning with the simple blowing of finely divided coal through pipes directly into the furnace combustion chamber to supplement the normal furnace fire for enhanced temperature and heat generation. Ignition of such supplementary coal came from the heat of the main fire, and little if any consideration was given to the control of fuel flow rates or fuel/air ratios necessary to achieve and control the shape, size, and oxidizing or reducing characteristics of the flame desirable for particular applications.

More recently, burner systems for large industrial furnaces have been developed to burn pulverized coal fed from grinding mills using air as a transport medium, see Crites U.S. Pat. No. 1,541,903 of June 16, 1925, entitled "Means for Pulverizing, Feeding, and Burning Fuel". The carrier air is often referred to as "primary" air. The main combustion air is supplied to the burner as "secondary" air, and some attention has been given flame characteristics in the supply of such air. However, there is a lack of precise control of coal/air ratios in primary mixtures fed to the burner and of flow rates of secondary air. Achievable turndown ratio, i.e. ratio of maximum to minimum firing rate, is about three to one, and there is no control of flame shape for particular purposes. The lack of precise control in the aforementioned respects severely restricts selection and control of flame characteristics. Attempted use of commercially available equipment with greater turndown ratio results in unstable combustion or in flameout.

Since coal is usually stored in piles unprotected from the weather, it is often wet at the time of use. Pulverizing and burning systems are normally equipped with coal-drying equipment in advance of feed to the pulverizing mill or at least the carrier air is preheated.

Burners for pulverized solid fuels suspended in air have, in some instances, utilized a conical deflector rigidly mounted in a predetermined fixed position at the discharge end of and extending downstream from the firing conduit of the burner. Thus, in Smith et al. U.S. Pat. No. 4,221,174 of Sept. 9, 1980, entitled "Direct Ignition of a Fluctuating Fuel Stream", such a deflector is employed to diffuse a discharging stream of air-suspended pulverized coal with which is mixed oxygen or an inert gas at varying ratios said to provide optimum conditions for ignition of the discharged fuel mixture. Again, in Gunnerman U.S. Pat. No. 4,249,471 of Feb. 10, 1981 entitled "Method and Apparatus for Burning Pelletized Organic Fibrous Fuel", such a deflector is similarly employed to diffuse a stream of air-suspended pulverized sawdust, or similar organic fiber, with which is mixed a flammable gas for subsequent ignition and burning.

Pulverizers utilizing a staged impeller for impacting friable solid material to be ground and for throwing the impacted material outwardly against other stationary impacting members in an environment of turbulent air flow which promotes autogenous attrition of solid particles are well known in the pulverizing of materials such as lithopone, titanium oxide, cocoa, sulfur, talc and the like in instances where impalpable powders of five micron size or less are desired. For example, see Lykken et al. U.S. Pat. Nos. 2,392,331 and 2,497,088 and Jackering U.S. Pat. No. 3,071,330. However, pulverizers or grinding mills heretofore used in conjunction with burners for pulverized coal have been impact crushers adopted from the metallurgical industry, for example the hammer mill used in the system of the aforementioned Crites U.S. Pat. No. 1,541,903.

OBJECTIVES

Primary objectives in the making of the present invention were to provide for effective pulverization of even wet coal in a system for pulverizing and burning solid fuels, principally in connection with industrial furnaces such as those used to heat gypsum-processing kettles and steam boilers, and in connection with rotary kilns and metallurgical furnaces; to enable use of ambient air as the carrier in contrast to the usual preheated air, and to accomplish effective drying of the wet material by means of heat generated internally of the pulverizer; to provide for substantially instantaneous ignition of the pulverized fuel in the burner and rapid heating to operating temperature for effective flame propagation; to provide for much migher turndown ratios than possible with presently available equipment; to provide for easily obtaining desired flame shapes for particular purposes; and to provide for optimum overall operation of such a system by utilizing observation of firing conditions in the ignition chamber of the burner to govern firing conditions.

SUMMARY OF THE INVENTION

With the foregoing in mind, the invention eliminates or substantially alleviates disadvantages of present solid fuel pulverizing and burning systems and provides for turndown ratios of fifteen to one or higher, as contrasted with the three to one of presently available equipment.

The burner of the invention has valved, longitudinally imperforate, fuel-firing nozzle means, preferably in the form of a movably positioned, double-tapered valve element at the discharge end of a longitudinally imperforate firing conduit for the pulverized solid fuel and in line with stream flow therethrough to enhance turbulence and control the quantity of the stream of air-suspended, pulverized, solid fuel fired into the ignition chamber of a furnace and the shape and character of the resulting flame. The quantity and velocity of fuel passed to the burner is largely controlled by the amounts of air and solid fuel material fed to the pulverizer.

Here, the pulverizer is unique in the drying action exerted on the solid fuel as it is being pulverized internally of the pulverizer by the inherent operating conditions therein.

Setting of the burner valve is determined for maximum operative effectiveness under actual operating conditions by observation of such operating conditions. Substantially instantaneous ignition is achieved on the basis of an initial valve setting in conjunction with a fluid-fueled pilot igniter, and rapid flame propagation is insured by reason of a heat retaining and reflecting ignition chamber of refractory material, which, in accordance with the invention, is cast to form as an integral block and through which flame-observation peep holes extend from the front of the burner. Observation of flame characteristics enable setting of the valve for optimum operation.

The pulverized coal may be consumed at selected rates, and the plume of flame may have a wide range of shapes and sizes and may have oxidizing or reducing characteristics and temperatures to meet the requirements of various industrial processing or space heating uses.

The valve element may be positioned inside the firing conduit upstream of the firing orifice thereof as shown in our aforesaid application Ser. No. 06/216,267, but is preferably positioned downstream from the firing orifice as shown herein.

THE DRAWINGS

In the drawings, which illustrate an embodiment of the invention typical of what is presently contemplated as the best mode for carrying it out in actual practice:

FIG. 1 is a fragmentary top plan view of an installation of a coal pulverizing and burning system of the invention in connection with a gypsum-processing kettle;

FIG. 2, a front elevation of the system of FIG. 1;

FIG. 3, a vertical section partly in elevation as taken on the line 3—3 of FIG. 1;

FIG. 4, a fragmentary, axial, vertical section through the burner portion of the system as taken on the line 4—4 of FIG. 2 and drawn to a larger scale;

FIG. 5, a vertical section taken on the line 5—5 of FIG. 4;

FIG. 6, a vertical section taken on the line 6—6 of FIG. 4;

FIG. 7 a vertical section taken on the line 7—7 of FIG. 4;

FIG. 8, a vertical section through the pulverizer portion of the system as taken on the line 8—8 of FIG. 3 and drawn to a larger scale;

FIG. 9, a horizontal section through the respective coal and air inlet conduits of the pulverizer portion of the system as taken on the line 9—9 of FIG. 3;

FIG. 10, a horizontal section through the pulverizer portion of the system as taken on the line 10—10 of FIG. 8;

FIG. 11, a similar horizontal section as taken on the line 11—11 of FIG. 8; and FIG. 12, a similar horizontal section as taken on the line 12—12 of FIG. 8, hidden portions below being shown by broken lines.

DETAILED DESCRIPTION OF ILLUSTRATED EMBODIMENT

Figure 1:
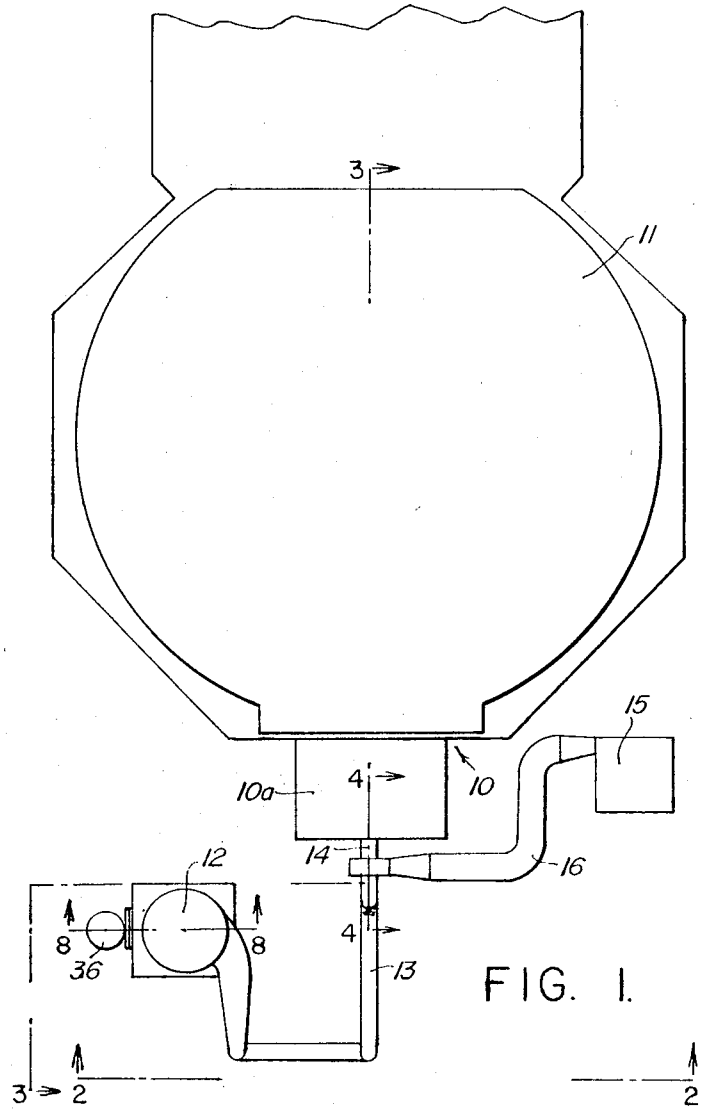
Figure 3:
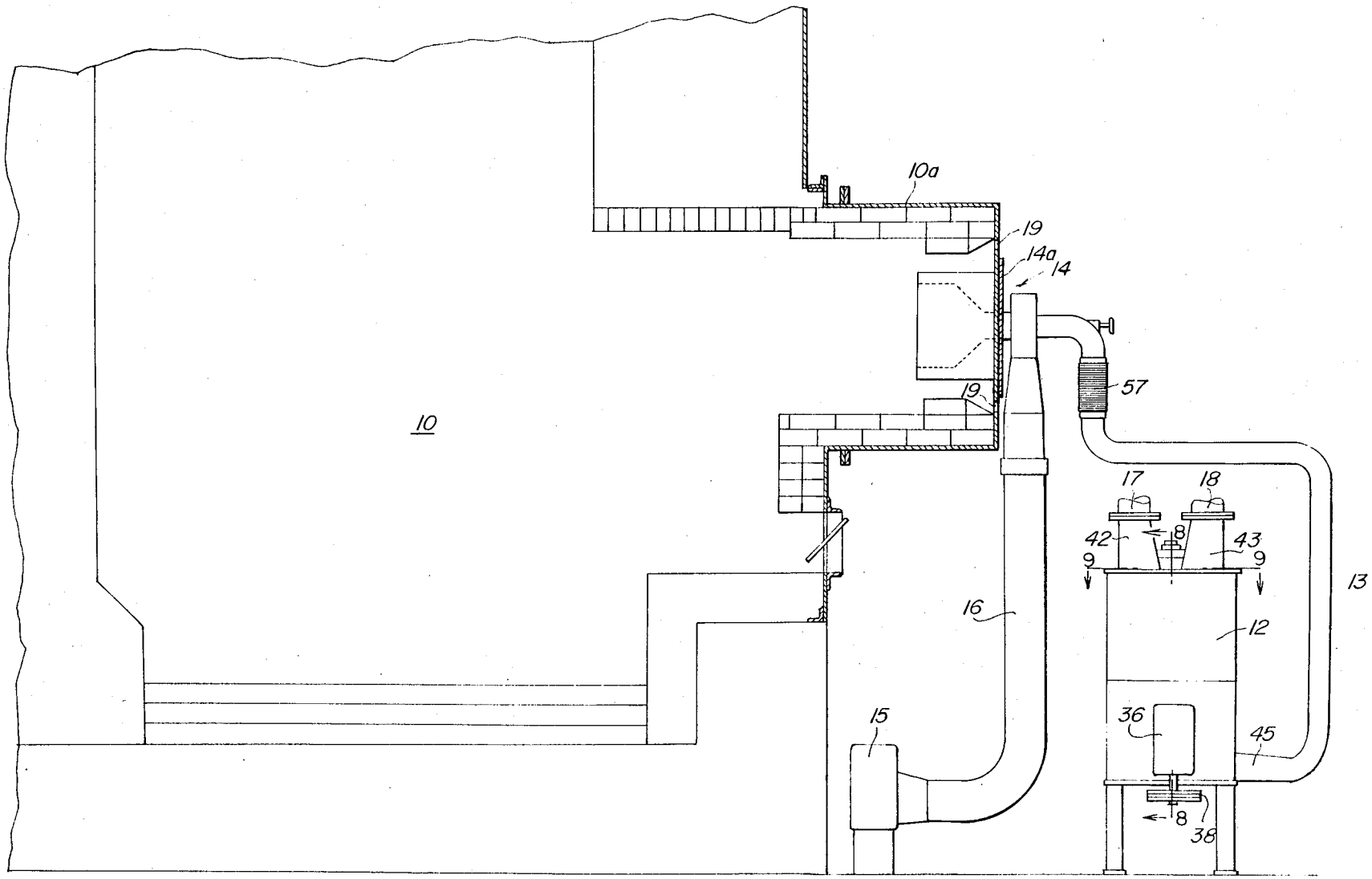
Figure 5:
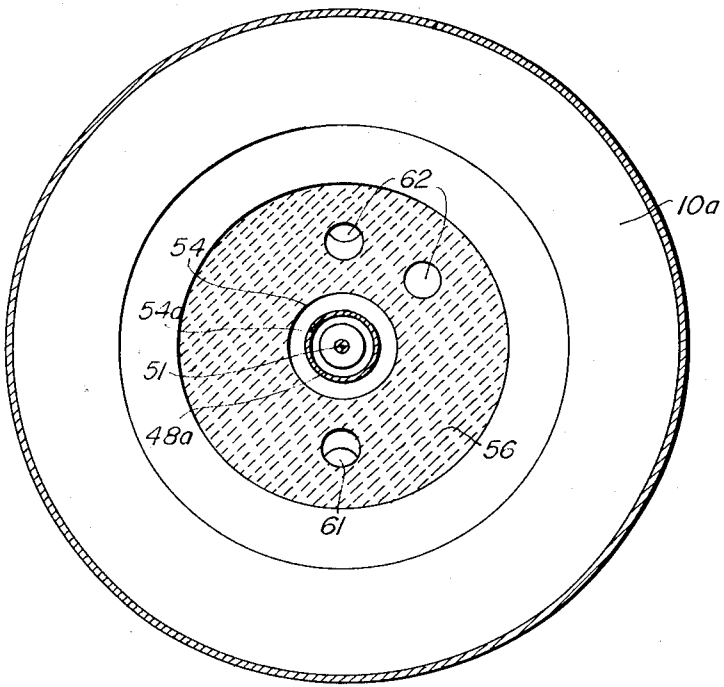
Figure 7:
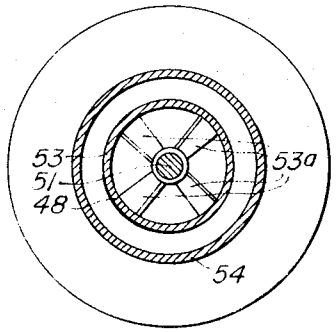

As illustrated, the system of the invention is applied to the usual furnace portion 10, FIGS. 1 and 3, of a conventional gypsum processing kettle 11, enabling such furnace to be fired with finely pulverized coal, about eighty percent of which is of forty micron particle size and all of which will pass a standard two hundred mesh screen.

Pulverized coal of this fineness is supplied on a continuous basis by a pulverizer 12 through a conduit 13 to a burner 14 attached to a forwardly protruding part **10*a* of the furnace 10 by means of a plate 14*a* which may or may not be provided as a part of burner 14. A blower 15 supplied ambient secondary air to burner 14 through a conduit 16, primary air carrying the pulverized coal in suspension being supplied by pulverizer 12 through conduit 13**.

Ambient primary air is supplied to pulverizer 12 through a conduit 17, FIG. 3, and run-of-the-mine coal (maximum size about two inches) is supplied through a conduit 18.

Figure 2:
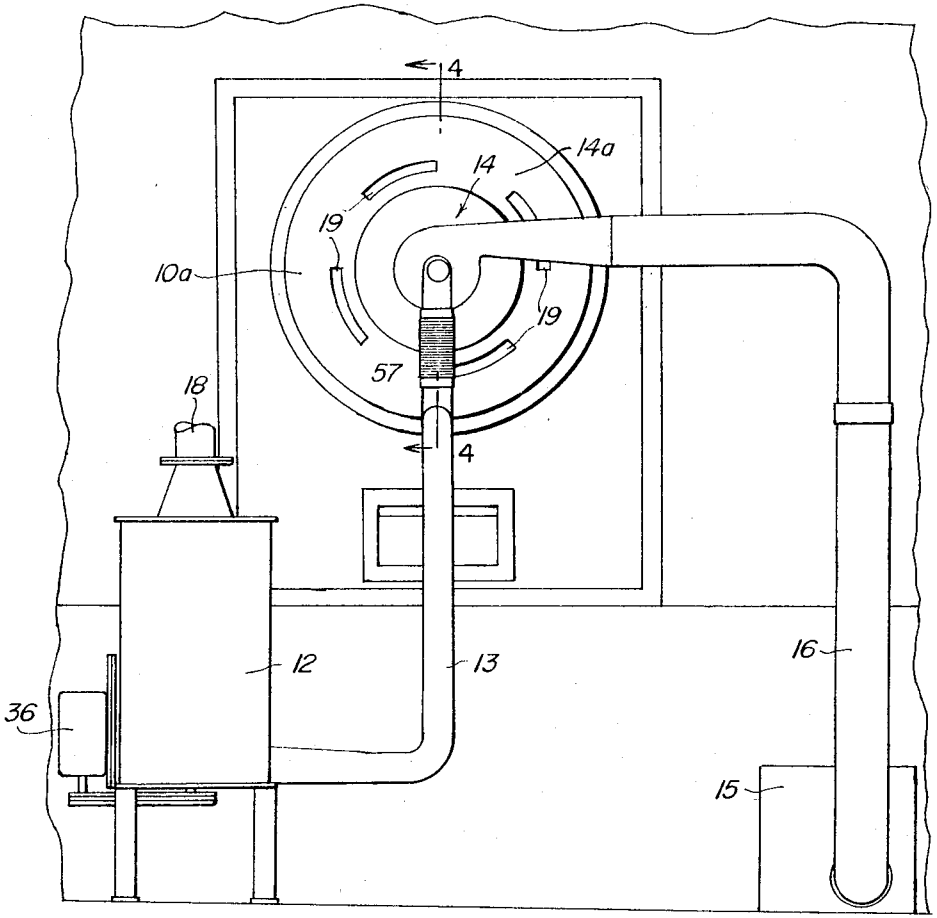
Figure 4:
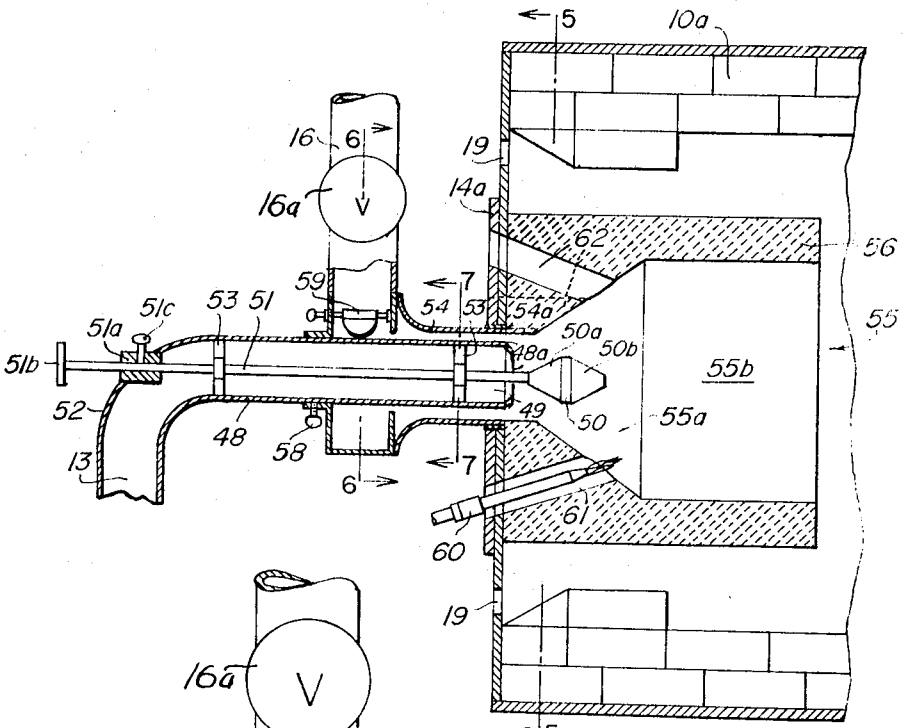
Figure 6:
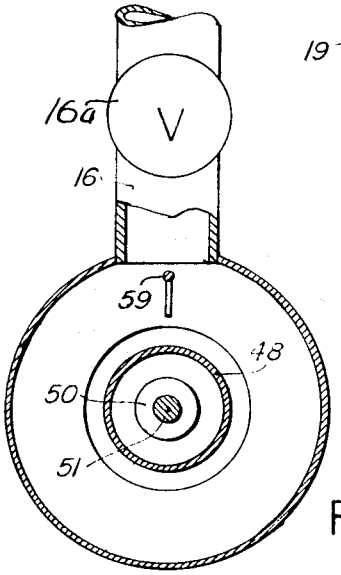

Tertiary air for helping to support combustion at and beyond the burner may be supplied through a series of openings 19, FIGS. 2, 3, and 4, provided in the front of the furnace circumferentially of the burner proper.

The pulverizer component of the present system is unique in a system of this kind in that, although machine impact is a factor, fineness of grind is achieved largely autogenously under drying conditions by particle-to-particle attrition. The downdraft pulverizer 12 herein specifically illustrated and described is believed to be new in and of itself and is claimed herein per se as a subcombination. However, other pulverizers of this general kind can be employed in this system so long as they perform in accordance with the teachings thereof. Thus, the updraft pulverizer illustrated and described in our copending application for patent, Ser. No. 304,860, filed Sept. 23, 1981, entitled "Apparatus and Method for the Pulverization and Burning of Solid Fuels", can be used, and, although vertical orientation is preferred to utilize the effect of gravity, other orientations are possible.

The details of down-draft pulverizer 12 are shown in FIGS. 8–12. A diametrically split, cylindrical housing 20, having bottom and top walls 21 and 22, respectively, is supported in vertical position by a stand 23. The two semi-circular sections of such housing are secured together by means of outwardly projecting flanges **20*a* and bolts 20*b*. Journaled in the bottom and top walls by bearings 24 and 25 are opposite ends, respectively, of a rotatable impeller shaft 26 to which are affixed, in mutually spaced relationship, a series of impellers 27, 28, 29, 30, and 31 representing successive pulverizing stages from the upper inlet end of the housing to the lower discharge end thereof. The impellers are preferably all imperforate, circular plates of uniform diameter, leaving respective, relatively narrow, annular spaces 32 between their circumferences and the inside cylindrical wall of the housing. They are mounted on shaft 26 by means of respective splined collars 33 and set screws (not shown). A series of horizontal, annular partitions 34 extend inwardly between mutually adjacent impellers of respective sets of same from circumferential securement to the inside face of hosuing 20, to direct flow toward the impeller axis in opposition to centrifugal force exerted by the impellers. The impellers are spaced from the respective partitions 34 to provide flow passages 35 therebetween as continuations of the annular spaces 32. An electric motor 36, supported from housing 20 by bracket 37, drives impeller shaft 26 through a belt and pulley drive 38**.

Figure 10:
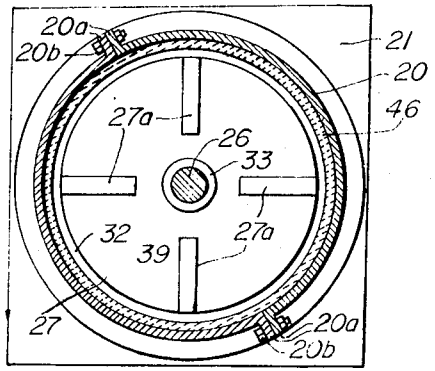

Uppermost impeller 27 has four radial bars 27*a* dividing the upper surface of its plate into quarter sections, as illustrated in FIG. 10. Bars 27*a* extend from the circumference of the plate inwardly toward, but short of, its collar 33 so as to leave an annular space 39 surrounding the collar. This impeller is designed to receive, mix and distribute inflowing air and coal, as well as to shatter coal pieces by impact of the bars 27*a* thereagainst and by impact of the coal pieces against the housing wall and against each other as they are thrown by centrifugal force.

Figure 9:
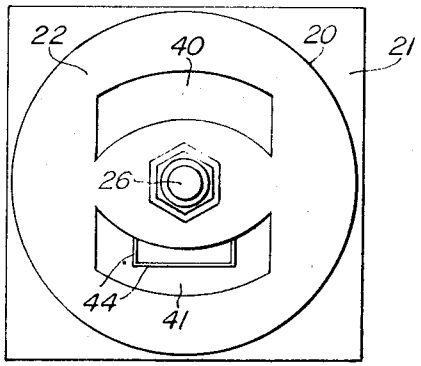

Inlet openings 40 and 41, FIG. 9, are provided through top wall 22 of housing 20 for connection with respective supply conduits 42 and 43, FIG. 3. One is for the supply of ambient primary air, the other for the supply of run-of-the-mine coal or other solid fuel which may be utilized in any given instance. They are preferably provided at diametrically opposite sides of impeller shaft 26. For best distribution of the air entering through its opening, such opening is preferably elongate rectangular in shape, with the longitudinal sides concavely curved toward the impeller axis, as illustrated in FIG. 9. Since it is desirable that the primary air and fuel supplies be interchangeable, both of the openings and conduits leading thereinto are preferably identical. Where, as here, the opening 41 and supply conduit 43 are used to supply the solid fuel, deflector skirts 44 may be provided to reduce the size of the fuel inlet opening relative to that for the air.

Solid fuel is conveyed to its supply conduit through a tramp iron detector (not shown) to avoid damage to the pulverizer.

Figure 8:
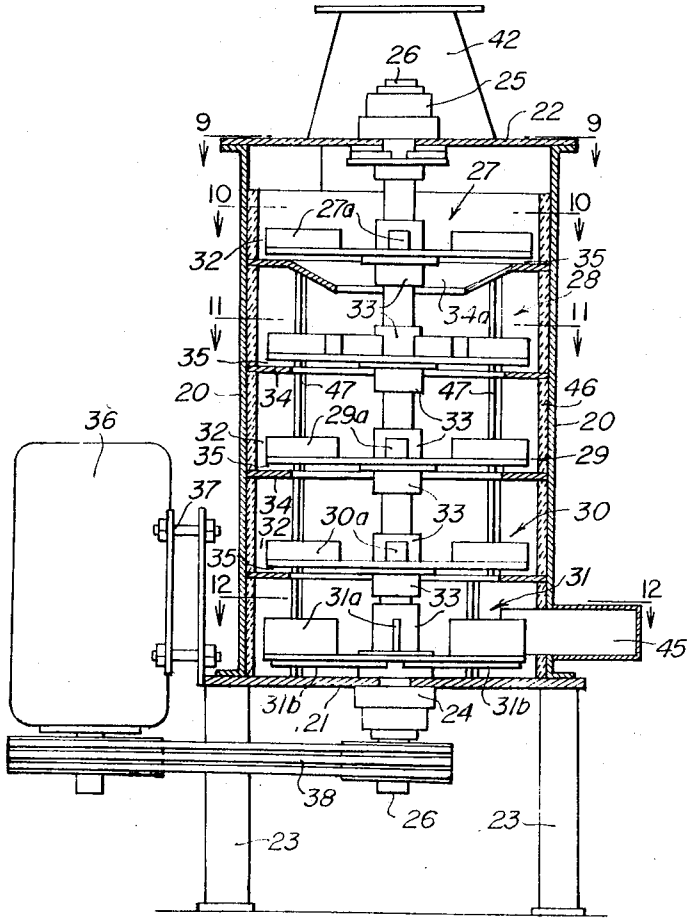

The spacings between the several impellers may be uniform, but in the illustrated instance are varied as shown in FIG. 8.

Figure 11:
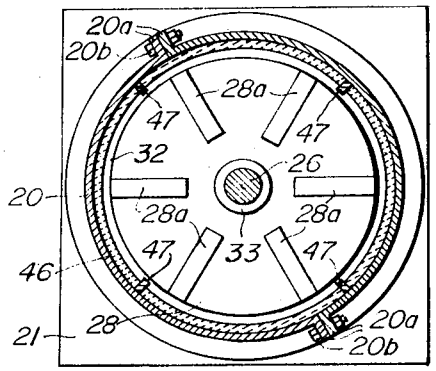

Second stage impeller 28 has six radial bars 28*a*, FIG. 11, instead of four, and impellers 29 and 30 of the third and fourth stages have four bars each, 29*a* and 30*a*, respectively, FIG. 8, the same as impeller 27 of the first stage.

Figure 12:
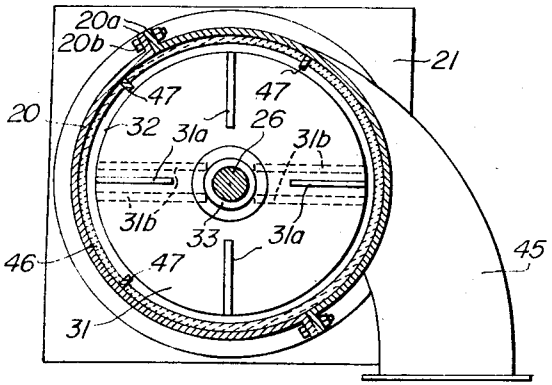

The fifth, i.e. final, stage effects discharge of the pulverized solid fuel suspended in air through a tangential discharge conduit 45, FIG. 12, which is connected by conduit 13 to burner 14. Impeller 31 of such fifth stage has four relatively thin and tall, air motivating vanes 31*a* placed radially on the upper surface of its imperforate plate similarly to but instead of the thicker and lower impact bars of the other impellers. Also, it has sets of diametrically opposite, mutually spaced, relatively slender bars 31*b* on its undersurface to stir up any tendency for solid particles to settle. The height of vanes 31*a* extends over much of the height of the discharge outlet so as to sweep the pulverized fuel and carrier air therethrough.

The inside cylindrical walls of housing 20 are preferably covered by a thick ceramic lining 46 to resist abrasion and consequent wear, as well as to aid in pulverization, and there are preferably provided mutually spaced, vertical, impact bars 47 secured to such inside cylindrical walls and projecting into the annular spaces 32 of stages second through fifth.

In order to funnel material from the first stage to the second stage, a downwardly-turned lip 34*a* is preferably provided as an addition to the uppermost annular partition 34.

In descending through the pulverizer, the turbulent air and solid fuel particle mix is funneled from the first stage onto the second stage, where it comes under the influence of a greater number of activating bars than in the first stage and then follows a sinuous or serpentine course as it passes through the several succeeding stages.

It should be noted that the input energy to the pulverizer is normally sufficient to produce operating heat effective to dry even wet fuel fed thereinto along with ambient air. Thus, energy input by motor 36 should provide an RPM for impeller shaft 26 that imposes an outer tip speed for the impeller bars and vanes of between 135 and 150 miles per hour, 146 miles per hour being optimum.

Burner 14 as here illustrated, FIGS. 4–7, comprises a firing nozzle which includes a longitudinally imperforate firing conduit 48, connected at one end to conduit 13 leading from pulverizer 12 and having a firing orifice 49 at the downstream, i.e. discharge end. Such firing orifice is advantageously defined by an inturned lip 48*a* sloping downstream, so as to direct the outflowing stream of carrier air and suspended solid fuel particles against a valve element 50, which is preferably double-taper-ended, as at 50*a* and 50*b*, and positioned in-line with flow of material to impart maximum turbulence to the emerging stream. The angles of the tapered ends of the valve element may be varied for particular applications.

Valve element 50 is secured to one end of an operating rod 51, which extends backwardly through firing conduit 48 and outwardly thereof through a packing gland 51*a* in the wall of an elbow 52 in the conduit. A handle 51*b* on the exposed end of rod 51 provides for convenient manipulation in either pushing or pulling such rod to position valve element 50 either farther away from or closer to firing orifice 49 to change flame shape for particular purposes and to otherwise control operating characteristics. A set screw 51*c* provides for locking valve element 50 in adjusted position.

Operating rod 51 is slidably supported by mutually spaced spiders 53 within firing conduit 48, which have vanes 53*a* angled to impart swirl to the stream of carrier air and suspended solid fuel particles.

Concentric with and surrounding firing conduit 48 is a secondary air conduit 54 extending in cantilever fashion from securement to burner plate 14*a* and having conduit 16 connected in flow communication therewith. The downstream end, i.e. firing orifice 49, of conduit 48 and the downstream end 54*a* of conduit 54 open into an ignition chamber 55 of the burner, which is defined by heat retaining and reflecting refractory material 56, to provide a divergent inlet portion 55*a* in which valve element 50 is positioned, and a discharge portion 55*b* of uniform diameter. Such material is advantageously a commercial refractory produced in powder form under the proprietary name of "Krusite" by A. P. Green Refractories Co., and is mixed with water and cast into final form as an integral block.

Firing conduit 48 is slidable within and along secondary air conduit 54 to place firing orifice 49 at variable distances from, or right at, the downstream end of secondary air conduit 54. A section of flexible pipe 57 in conduit 13 accommodates the movement of the firing conduit, and a set screw 58 provides for locking it in its adjusted position. The flow velocity in firing conduit 48 is sufficient to suspend enough pulverized coal particles to render the primary mixture in such conduit too fuel-rich for effective combustion, or at least sufficiently rich in coal particle content relative to air content for a low flame propagation rate such as will prevent flash-back.

In practice, the weight of air in the primary mixture may range from 10% to 30% of the mixture weight, but should be maintained constant for any particular application.

Introducing secondary air into the primary fuel feed mixture adjusts the coal/air ratio of such primary mixture for ignition and combustion. The amount of secondary air supplied is controlled by a valve 16*a*, FIG. 4, in conduit 16 to produce oxidizing, reducing, or stoichiometric combustible mixtures as desired for the particular application and to at least partially control the shape of the flame plume in the furnace.

A vane 59 may be pivotally mounted at the entrance of secondary air from conduit 16 into conduit 54 for selective angular orientation, so that an adjustable swirling component of velocity is imparted to the secondary air as it enters conduit 54. The swirling component persists through ignition chamber 55 to help shape the flame plume. Making use of valve 16*a*, the operation may induce more pronounced swirls to air the valved firing nozzle to produce correspondingly more full, but shorter plumes, and vice versa.

For start-up of the furnace, the position of firing conduit 48 is first adjusted relative to secondary air conduit 54 in accordance with firing conditions, and valve element 50 is positioned about three inches from firing orifice 49. Motor 36 of pulverizer 12 and blower 15 supplying secondary air to burner 14 are energized.

To effect ignition, the flame from an igniter torch 60, FIG. 4, is directed into the highly turbulent mixture of air and pulverized solid fuel in ignition chamber 55 by way of an igniting passage 61, which extends from the front of the burner through plate 14*a* and the block of refractory material 56 and opens into the ignition chamber. Ignition should take place instantaneously.

Following ignition, torch 60 is kept burning for about five minutes while the refractory material 56 is being brought to operating temperature and during observation of flame propagation. In the present instance, observation is carried out manually through peep passages 62, FIG. 4, which, like igniting passage 61, extend from the front of the burner through plate 14*a* and the block of refractory material 56 to open into ignition chamber 55. Although only one such peep passage could serve the purpose, it is preferred to employ two or more strategically located for substantially complete viewing of conditions in the ignition chamber. Based on such observation, the operating position of valve element 50 is established by movement thereof from its initial position either toward or away from firing orifice 49. Although it is not usually necessary to readjust the position of firing conduit 48 to relocate its firing orifice 49 relative to the annular discharge orifice of secondary air conduit 54 at its end 54*a*, that can be done if found expedient in order to establish optimum conditions for flame propagation in and beyond ignition chamber 55.

In operation, refractory block 56 becomes heated to a temperature of from about 2000° to 3000° F., and serves as a continuing source of ignition heat for the fuel feed to the burner.

To adjust the coal feed rate, i.e. turndown ratio, for or during operation of the furnace, valve element 50 is positioned, as previously indicated, by manipulation of rod 51 to adjust flow of the primary fuel mixture into the ignition chamber. The supply of secondary air is then adjusted by means of valve 16*a* for the desired coal to air ratio. It should be noted that the combustion energy provided by the system is controlled and maintained by input of fuel and air. In practice, the operator usually first adjusts the flame in this manner and then makes whatever further adjustments therein and to the setting of vane 59 and to valve 16*a* that may be required to modify flame swirl to achieve shape of flame plume suitable for the particular application. If necessary, he may analyze the furnace exhaust gases to determine the oxidizing or reducing character of the flame.

The capability of the burner of the invention to accommodate large variations in coal consumption for achieving various desired results in the operation of a furnace or boiler is believed to come largely from thorough mixing of pulverized coal and air in both the pulverizer and the firing of the burner and by the reliability of continuing ignition. Coal feed rates to the burner can be successfully adjusted over a turndown ratio range of 15:1, or higher, with stable combustion and without flameout or flashback. Within that range, the shape, temperature, and oxidizing or reducing potential of the flame plume may be varied widely and controlled closely. The shorter, more expansive plume preferred for boiler heating is readily achieved with the lower coal firing rates, the flow of secondary air being adjusted for relatively rapid combustion. The longer plume preferred in industrial process furnaces is achieved with higher coal firing rates. The previously discussed adjustable swirling of injected secondary air provides further flame shape control at the selected mixture ratio and coal consumption rate.

For firing rates of $\frac{1}{4}$ to $\frac{1}{2}$ ton per hour, the firing conduit 48 of the firing nozzle may be four inches in diameter, recirculation conduit 54 six inches in diameter, firing orifice 49 three and one-half inches in diameter, portion 55*b* of ignition chamber 55 fourteen inches in diameter, and the overall length of the ignition chamber twenty-four inches.

The illustrated embodiment may be varied without departing from the essential features of the invention heretofore set forth. Thus, the firing nozzle may incorporate manifolding to accommodate two or more burners simultaneously utilizing a single pulverizer, or more than one firing nozzle may be served by a single pulverizer.

For observation purposes, an ultraviolet scanner, such as a Honeywell "Mini Peeper", No. C7027A-1023, is installed in each passage 62.

Although manual observation is a convenient procedure, it will be apparent to those skilled in the art that electronic observation and automatic control of valve setting or settings can be carried out instead of manual.

In the continued operation of the furnace after start-up, standard automatic controls normally employed to govern the firing of fluid fuels, such as gas and oil, are employed, with feed of the solid fuel and of primary air being based on the turndown ratio desired at any given time.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A solid fuel pulverizing and burning system characterized by a possible turndown ratio of up to at least fifteen to one and comprising a pulverizer for impacting relatively coarsely sized solid fuel and autogenously pulverizing it in turbulent air, said pulverizer having a housing with means for introducing solid fuel to be pulverized, means for introducing ambient primary air, impeller means, and discharge means for passing a stream of the primary air and autogenously pulverized solid fuel to a burner for firing into the ignition chamber of a furnace or other heating structure; a burner having means defining an ignition chamber, an elongate, firing conduit having one end in communication with said discharge means of the pulverizer and the opposite end in communication with said ignition chamber as a firming orifice; said conduit being adapted to pass said stream from end-to-end thereof and into said ignition chambers through said firing orifice; a valve element movably mounted relative to said firing orifice for adjustment closer thereto or farther therefrom as a primary air and fuel feed control valve, said conduit being relatively long and longitudinally imperforate so as to confine the longitudinally extensive flow of said primary air and fuel stream therethrough; structural means within said conduit and mutually spaced along the length thereof for imparting turbulence to said longitudinally extensive flow of primary air and fuel prior to its discharge from said conduit and its entering said ignition chamber; means for introducing a controlled quantity of secondary air into the turbulent stream after its discharge through said firing orifice; means for igniting the pulverized solid fuel in said ignition chamber; means for observing conditions within said ignition chamber; and means for adjusting the position of said valve element relative to said firing orifice in accord with observed conditions in the ignition chamber to control the quantity of primary air and fuel fired into said ignition chamber and to influence flame propagation and flame shape.

2. A system according to claim 1, wherein the pulverizer comprises a shaft rotatably mounted in the housing; a series of impellers fixed to said shaft in mutually spaced arrangement defining respective pulverizing stages and terminating short of said housing to provide circumferential flow space therearound, said impellers being provided with air-motivating, solid particle impact members thereon; air inlet means adjacent to one end of said housing as the means for introducing primary air, to provide a carrier stream of air; solid fuel inlet means adjacent to said one end of the housing as the means for introducing solid fuel to be pulverized; discharge conduit means adjacent to the other end of the housing and connected to the firing conduit as the means for passing the carrier stream of air and pulverized solid fuel to the burner; and means for rotating the impeller shaft.

3. A system according to claim 2, wherein the pulverizer additionally comprises a series of annular partitions fixed to the housing and extending peripherally thereof and between mutually adjacent impellers of respective sets of said mutually adjacent impellers to direct flow toward the impeller axis in opposition to centrifugal force exerted by the impellers.

4. A system according to claim 3, wherein the air inlet means and the fuel inlet means are arranged to discharge directly against the first stage impeller; and wherein the second state impeller is provided with a greater number of impact members than is said first stage impeller.

5. A system according to claim 4, wherein the annular partition between the first and second stage impellers has additionally a discharge lip turned inwardly toward the axis of the impellers to funnel material from said first stage to said second stage.

6. A system according to claim 2, wherein the inside face of the housing is provided with impact bars spaced peripherally thereof and positioned within the said flow space.

7. A system according to claim 3, wherein the housing is cylindrical and it and the impeller shaft are positioned vertically, with the upper end of the housing closed by a top wall; wherein the impellers and annular partitions extend horizontally; and wherein the primary air inlet means and the solid fuel inlet means are located in said top wall.

8. A system according to claim 7, wherein the primary air inlet means and the solid fuel inlet means comprise respective elongate, substantially rectangular openings through the top wall of the housing at diametrically opposite sides of the impeller axis; and flow conduits leading to the respective openings.

9. A system according to claim 8, wherein the long sides of the rectangular, elongate, air inlet opening are substantially uniformly, concavely curved toward the impeller axis.

10. A system according to claim 9, wherein both the primary air inlet opening and conduit and the fuel inlet opening and conduit are similarly formed so as to be interchangeably used, and wherein deflector skirts are provided in the one selected as the solid fuel inlet so as to reduce its size relative to that of said air inlet.

11. A system according to claim 7, wherein the discharge conduit means opens substantially tangentially into the lowest impeller stage through the cylindrical side wall of the housing, and the impeller of said stage has vanes fixed to and projecting from its upper surface substantially within the height of the opening into said discharge conduit means so as to serve in effect as an ejector fan for the carrier stream of primary air and the pulverized fuel entrained therein.

12. A system according to claim 1, wherein the construction and arrangement of the pulverizer and the means for operating it are such that the energy input during operation is sufficient to generate fuel-drying heat internally of the housing during operation with ambient air input and to produce finely pulverized solid fuel, about 80% of which is 40 microns in size and all of which will pass a standard two hundred mesh screen.

13. A system according to claim 1, where provision is made for the inflow of tertiary air to the furnace so as to surround the means defining the ignition chamber with a flow of said tertiary air.

14. A system according to claim 1, wherein the firing orifice is defined by an inturned, circumferential lip sloped toward the ignition chamber.

15. A system according to claim 1, wherein the valve element of the burner is double-taper-ended and is positioned in-line with flow of material through the firing orifice.

16. A system according to claim 1, wherein the means for introducing secondary air is a conduit concentric with and surrounding the firing conduit and opening into the ignition chamber of the burner, said firing conduit being slidable longitudinally relative to the secondary air conduit and to the ignition chamber, so as to permit selective positioning of the firing orifice relative thereto; and wherein means are provided for securing said firing conduit in the selected position.

17. A system according to claim 1, wherein the valve element is fixed to one end of an elongate rod which extends backwardly through the firing conduit to a location exteriorly thereof; and wherein mutually spaced spiders within said firing conduit slidably support said rod, said spiders being formed with slanted vanes as the means for imparting turbulance to the fuel and primary air flowing through the conduit.

* * * * *

UNITED STATES PATENT AND TRADEMARK OFFICE

CERTIFICATE OF CORRECTION

PATENT NO. : 4,531,461

DATED : July 30, 1985

INVENTOR(S) : William H. Sayler & Justin Chad White

It is certified that error appears in the above-identified patent and that said Letters Patent is hereby corrected as shown below:

Claim 1, line 19, "firming" should be "firing"

Claim 1, line 22, "chambers" should be "chamber"

Claim 4, line 4, "state" should be "stage"

Claim 13, line 56, "where" should be "wherein"

Signed and Sealed this

*Twenty-fifth* Day of *March 1986*

[SEAL]

*Attest:*

DONALD J. QUIGG

*Attesting Officer*

*Commissioner of Patents and Trademarks*